United States Patent [19]

Nygård

[11] Patent Number: 4,599,075

[45] Date of Patent: Jul. 8, 1986

[54] SURVIVAL SUIT

[76] Inventor: Holger B. Nygård, Nappa Lofoten, N-8382, Norway

[21] Appl. No.: 661,660

[22] Filed: Oct. 17, 1984

[30] Foreign Application Priority Data

Feb. 18, 1983 [NO] Norway ..... 830568

[51] Int. Cl.[4] ..... B63C 9/08

[52] U.S. Cl. ..... 441/103; 441/104; 441/105; 2/2.1 R

[58] Field of Search ..... 441/102–119; 2/2.1 R, 2.1 A, 269, 69.5

[56] References Cited

U.S. PATENT DOCUMENTS

| | | | |
|---|---|---|---|
| 1,108,756 | 8/1914 | Himle | 441/104 |
| 1,901,859 | 3/1933 | Anderson | 441/105 |
| 1,909,180 | 5/1933 | Jackson | 441/103 |
| 2,023,351 | 12/1935 | Aud | 441/103 |
| 2,316,101 | 4/1943 | Norred | 441/105 |
| 3,076,206 | 2/1963 | Shaw | 441/104 |
| 4,125,910 | 11/1978 | Nicholai | 2/69.5 |
| 4,206,512 | 4/1980 | Osborne | 2/69.5 |
| 4,507,805 | 4/1985 | Calutoin | 2/69.5 |

*Primary Examiner*—Trygve M. Blix
*Assistant Examiner*—C. T. Bartz
*Attorney, Agent, or Firm*—Barnes & Thornburg

[57] ABSTRACT

Survival suit mainly for use in water, made of a pliable material allowing the wearer to swim easily while wearing the suit. The suit consists of a watertight outer skin (a) and of an inner skin (b) which are held together by an interlayer (9) which acts as insulation. The mid-section (7, 8) of the suit is designed and functions like bellows or folds (5, 7, 8). These folds start down at hip level and extend upwards on the suit. The purpose of this design is to allow the wearer to withdraw his arms from the sleeves (6) and bring them into the main body (16) of the suit in order to attend to his personal hygienic needs or to be able to rub the parts of his body which suffer from the cold.

9 Claims, 10 Drawing Figures

SURVIVAL SUIT

This application is a continuation of copending PCT Application No. 84/00001 filed Jan. 9, 1984, now abandoned.

The present invention concerns a survival suit for use at sea, which aims at preventing important drops in body temperature and at making the time spent in water as comfortable as possible.

Experience has shown that human beings cannot survive for very long in water even when the temperature is relatively high. At 10 degrees Celsius the situation will become critical for most people after a few minutes only.

Many people were convinced that the life jacket would save lives in cases of shipwreck. This is true when the rescue team arrives shortly after the event.

If one must remain in water for a length of time, the jacket will keep one afloat but will not prevent freezing to death.

Remaining in cold water for a length of time causes the functions of the body to slow down. The temperature of the body drops rapidly. Even a short stay in cold water can be fatal. In other words, it is the cold that kills.

In order not to freeze to death in water, it is necessary to be well insulated. Insulating will reduce loss of body heat. The better the insulation, the longer one can survive.

This must not be considered separately from the ability to produce body heat, the layer of fat under the skin, and the reduction in loss of body heat. A combination of physical activity and good insulation in a dry suit will give the best protection. On the other hand, a combination of activity and direct contact with the water will be very unfortunate as water is a very good heat conductor and can absorb large quantities of heat.

The use of survival suits has consequences also for the rescue teams at sea. The use of suits will increase the period of time when it is still possible to find survivors after a shipwreck. With the use of dry suits with high buoyancy, the action of strong winds will increase the size of the area over which one must search for survivors. Combined with bad weather conditions like heavy sea and low visibility (blizzard), this will mean that people who could have been saved must instead face a long and painful agony due to the use of survival suits as they are today.

Various types and makes of survival suits are found on the market today. Each type is built for particular areas of use at sea, to protect the wearer against the effects of body-heat loss, fire, blows, etc. One particular manufacturer produces one type of suit for sailors and fishermen and another type for off-shore use in the petroleum industry. Both dry and wet suits can be found on the market.

To be approved for use, the survival suits in use today must comply with the regulations issued by the Norwegian Directorate of Shipping and Navigation. These regulations stipulate the areas of use for the suit and definite requirements as regards material, buoyancy, the protection provided against the cold, the protection provided against fire, the way one gets into the suit, its mobility, the field of vision it allows, its conspicuousness, packing, markings, etc. The suit must be a dry suit (keep the body dry) and it is required to have a guaranteed buoyancy in water.

In the regulations in force for the approval of survival suits, the outer functional requirements are particularly stressed while comfort and mobility take second place. For instance, nothing is mentioned about important hygienic requirements such as collection and evacuation of urine and faeces, or the intake of fluids and of solid food which are considered essential in cases of prolonged use of the suit.

One other important condition for surviving a prolonged stay in water is the possibility of physical activity inside the suit in order to maintain body temperature and prevent unnecessary heat loss from such parts of the body as arms and legs. It is also necessary to protect the face against the cold and the head against blows. Such conditions are ignored in the manufacture of the suits one finds on the market at present.

A series of tests of approved survival suits carried out by the Norwegian Underwater Technology Center in Bergen, and dated 22nd Nov. 1982, has revealed several weak points in today's survival suits. Most suits are particularly weak or unsatisfactory on three points, and these are as follows:

In general, dry suits are not 100% watertight over a length of time. The survival time is therefore considerably reduced. There is known to be leakage, mainly between the face and the suit, but also in other places.

Insulation is inadequate on the whole.

The suit's buoyancy is not constant. For use in helicopters, watertight suits (dry suits) have, in most tests, been shown to have too high a buoyancy due to the formation of air pockets inside the suit. On the other hand, when filled with water, the suit has, in some instances, shown too low a buoyancy and at times a dangerous lack of stability.

The present invention is based on a further development of today's dry suit where material, insulation and equipment satisfy all the requirements and show, in certain cases, a considerable improvement on those in use today. In other words, the suit will be made of the best and safest materials developed at any time.

With the new survival suit, one aims at ensuring that a person will be able to remain in water, whatever the circumstances, for a considerably longer period of time than allowed by today's suits, and without suffering serious injuries. The survival time ensured is required to be of several days, given a normal state of health for the wearer, and under normal natural conditions.

With this goal in mind, the inventor has anticipated the functional requirements of tomorrow's suit to satisfy the personal needs of the wearer. This satisfaction in itself is a determining factor for increasing the survival time in the suit. Such developments in the functional requirements of survival suits are as follows:

Improving the insulation in general, and in particular around the head, back and lower leg.

The dry suit must be 100% watertight. In particular, the facial seal must be improved, or another system must be designed.

Improving the conditions concerning personal hygiene, especially the collection of urine, and providing the possibility for the wearer to absorb emergency rations and fluids in particular.

Increasing physical activity within the suit to contribute to maintaining body temperature. Rubbing is especially important for improving the blood circulation.

Reducing the area of the body which is exposed to the surroundings. This aims at diminishing heat loss and at giving the wearer a deeper sense of security.

Protecting the face against injuries caused by fire or frost, against soiling by oil or other products, and protecting the head and neck against blows.

Giving the wearer the possibility to doze off in his suit without fear of choking or of other dangers.

In accordance with the present application, the above functional requirements are met when the suit is built as indicated in the characterizing portion of claim 1.

The insulation used for the suit, in particular for the head, back and lower legs, will be an improvement on the best types of insulation in use today. In addition, the suit is designed to accommodate a helmet which is locked on to the suit with a watertight seal. Further characteristics of the invention are given in the claims 2–3.

FIGS. 1, 1A, 1B, 2, 3, 4, 5, 6, 7 and 8 illustrate the design of the invention.

FIG. 1 is a front plan view of an embodiment of the suit with helmet attached;

FIG. 1A is a sectional view taken along lines A—A of FIG. 1; and

FIG. 1B illustrates the leg section of FIG. 1A with the fastening device released to allow expansion in the suit leg.

FIG. 2 shows how the size and spaciousness of the suit alter with arm and leg movements.

FIGS. 3, 4 and 5 show how arms and legs can be withdrawn from sleeves and suit legs and are accommodated inside the main body of the suit.

FIG. 6 shows the distribution of the insulating material around the suit.

FIG. 7 shows the suit with helmet.

FIG. 8 illustrates the design of the helmet.

FIGS. 1 and 7 show the suit (1) equipped with the helmet (2) which is locked onto the suit (1) by means of a watertight sealing mechanism (3). The suit (1) is designed with a hood (12) which covers the head and part of the face to give a fully covering suit.

The hood (12) has a layer of insulating material (9) and a layer of shock absorbing material (13) over most of the head to protect the skull from the cold and from blows.

Figure 8:
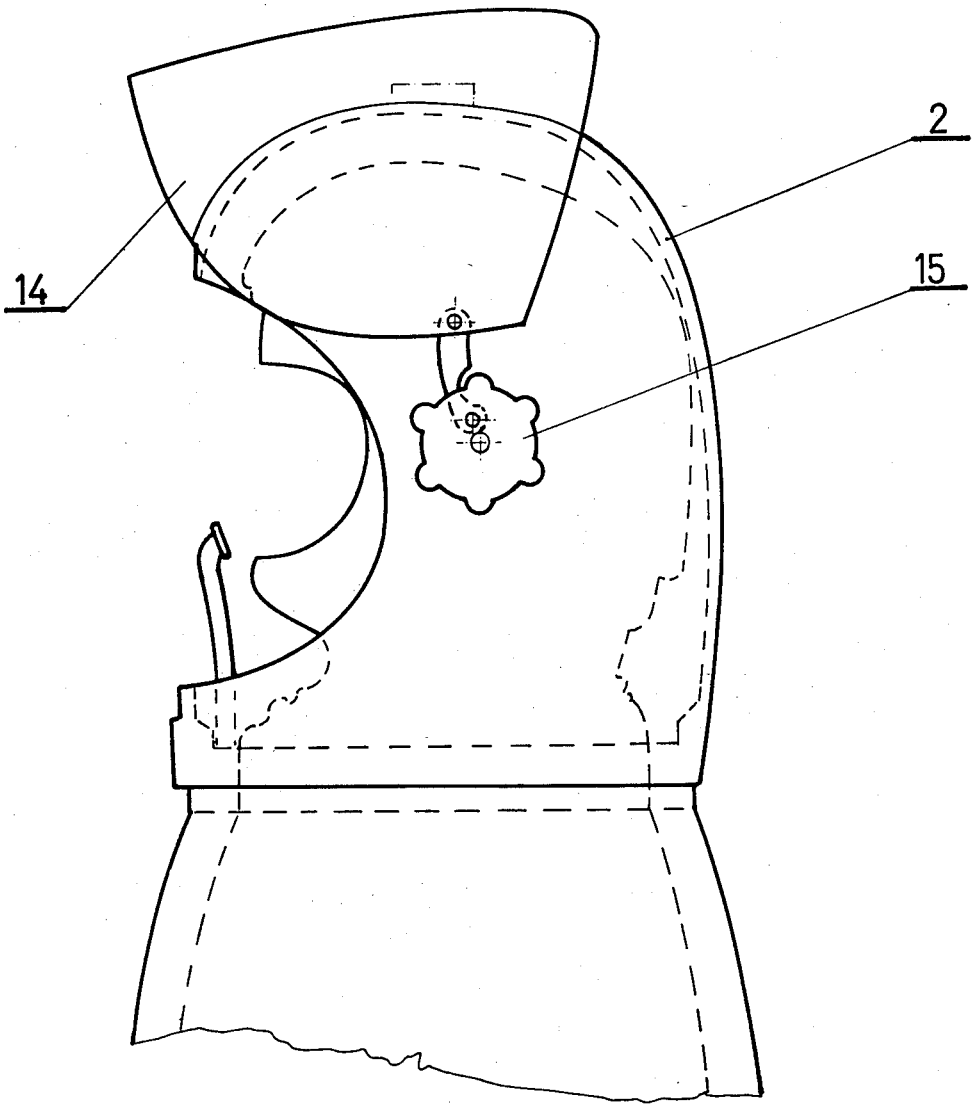

The helmet (2) is equipped with a flap-window (14) which can be opened and closed. See FIG. 8. When closed, the window (14) fits tightly over the helmet (2). Watertightness is achieved by help of two window locking devices (15) which are tightened when the window (14) is in place in front of the face, to give a watertight seal.

Figure 1:
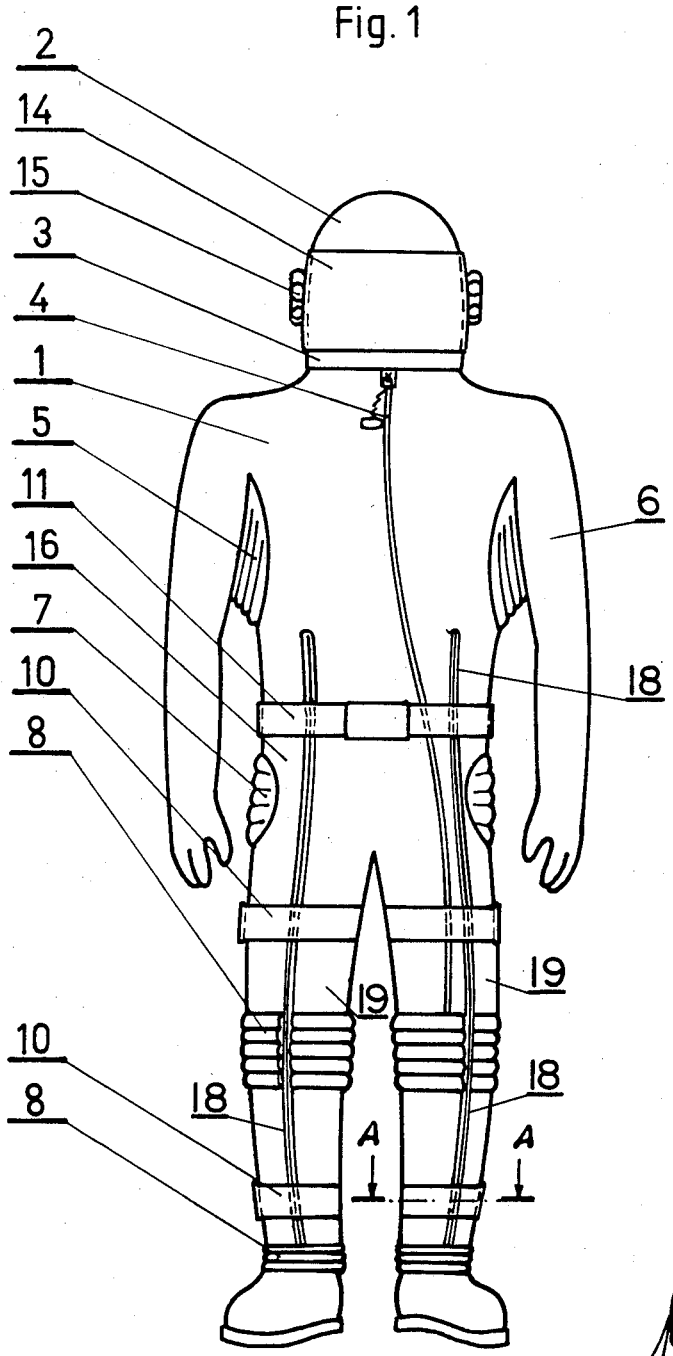
Figure 1:
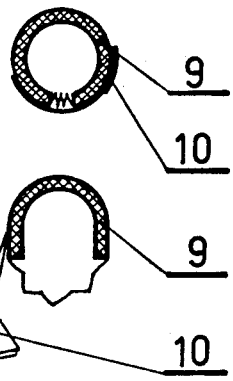
Figure 2:
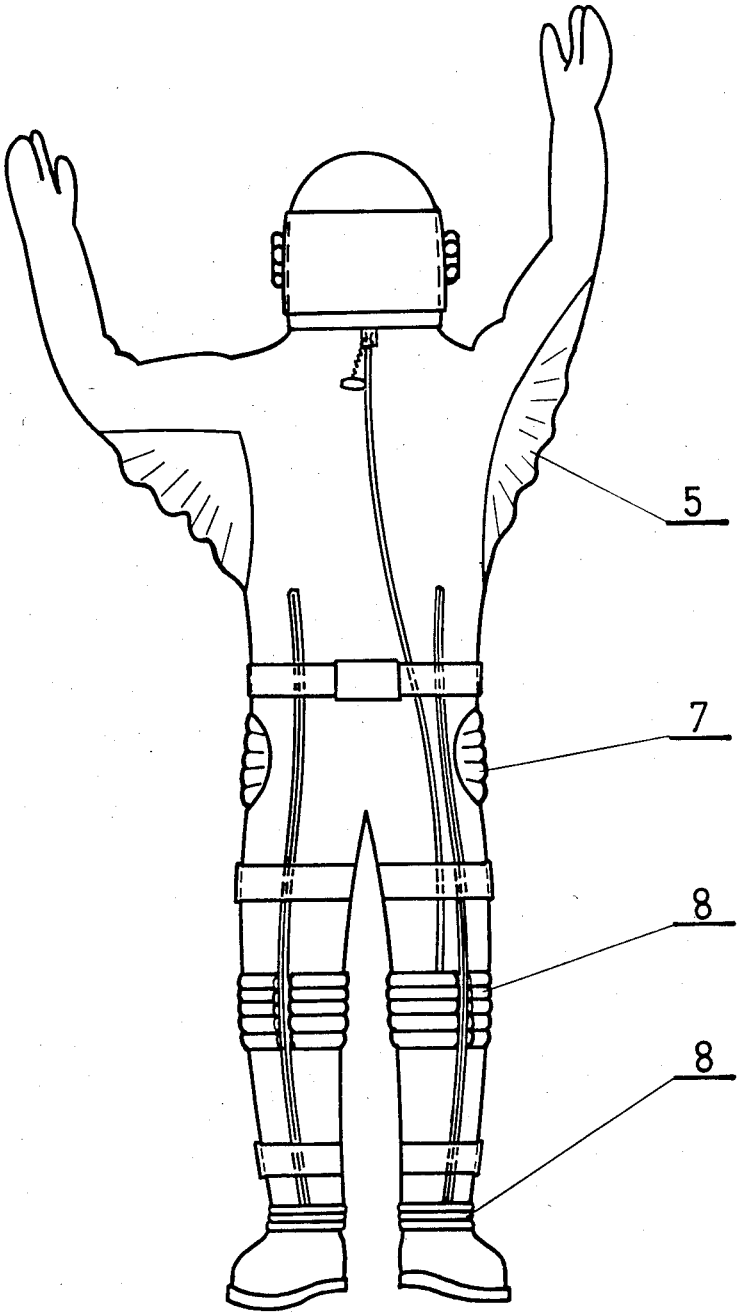

FIG. 1 shows in addition a second fastening device (4) for opening and closing the suit and enabling a person to put the suit on.

Figure 3:
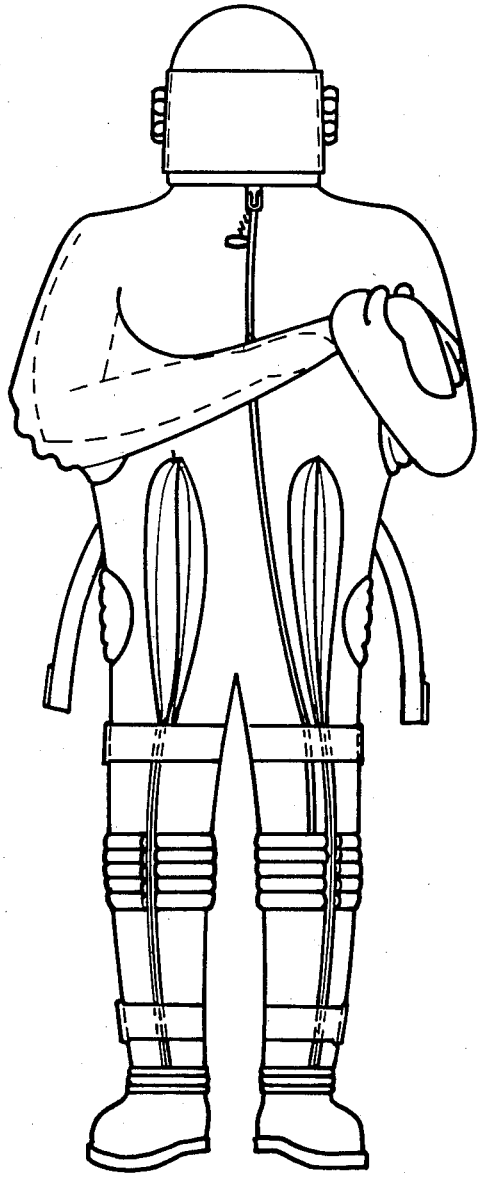
Figure 4:
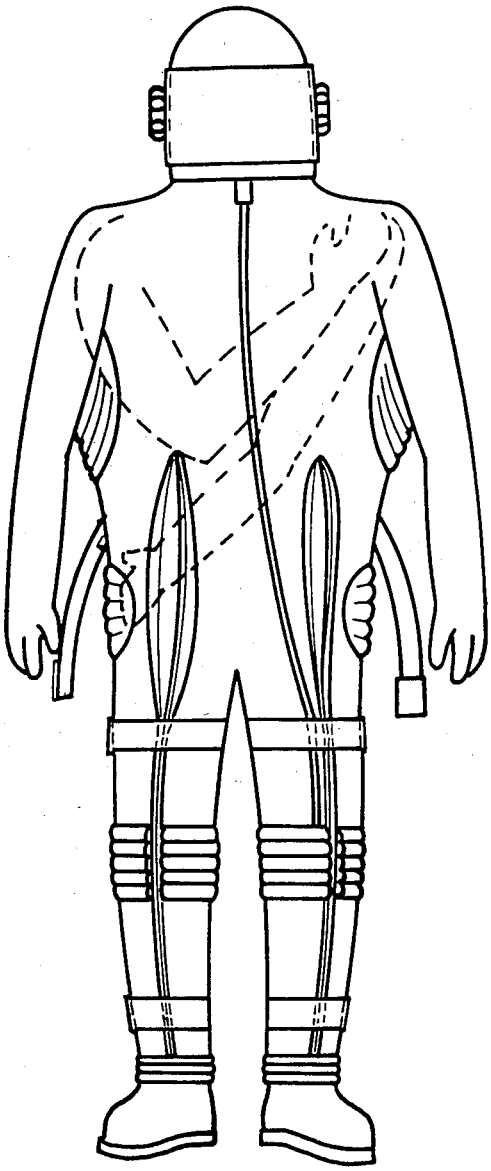

The suit (1) is so designed at armpit level (5) as to provide for an increase in spaciousness. The armpit sections (5) can be built on the bellows principle. This design will enable the wearer to withdraw his arms from the sleeves (6) and bring his arms inside the main body of the suit (16) as shown in FIGS. 3 and 4.

This sleeve design, combined with the inserts of the thighs (7) and of the lower legs (8), and the insulation layer which is split along the whole length of the leg, will give the possibility to increase the spaciousness of the suit and thus to alter one's position inside the suit. Such construction details will not make the suit less functional nor less comfortable to wear on board a ship or in similar places.

The aim of such flexible construction is to achieve freedom of arm movements inside the suit (1) to meet the requirements of physical activity and of elementary hygiene.

The most important of those requirements are:

Freedom of arm/leg movements and possibility of rubbing the body to increase blood circulation and maintain body temperature.

Collection of urine and faeces in special plastic bags which follow the suit.

Intake of emergency rations, especially fluids, from plastic bottles via a tube and-valve system.

The thigh part (7) and lower leg section (8) of the suit are also designed with bellows like inserts, and the insulation (9) is built in such a way that the spaciousness of the leg can be increased by unfastening a quick-release binding (10). The wearer will thus be able to bring his legs out of the suit legs (19) and into the main body of the suit.

Figure 5:
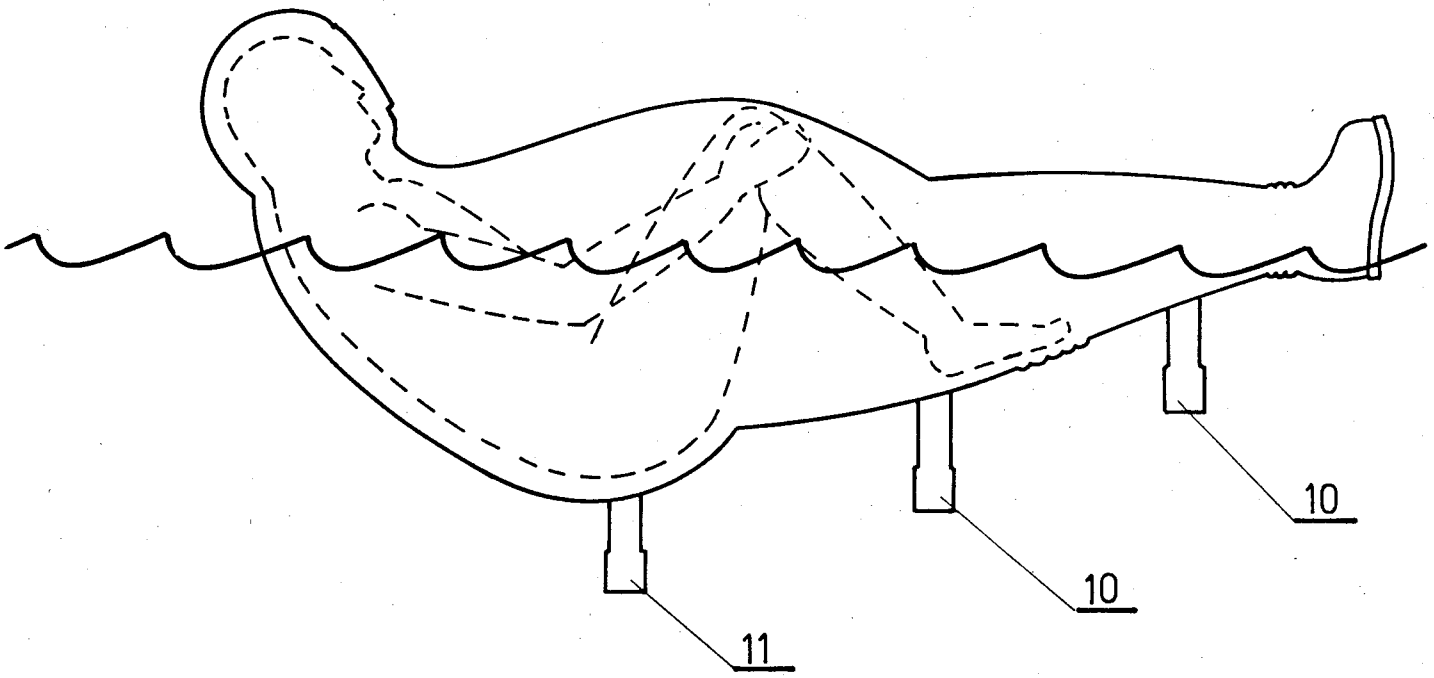

The wearer can adopt a comfortable position inside his suit as shown on FIG. 5. Such a position reduces the surface exposed and the loss of heat to the cold surroundings, and gives at the same time a sense of security in an otherwise unpleasant situation.

To maintain the suit in a stable and favorable position, weighted straps (11) can be unfastened. See FIG. 5.

When unfastened, these weighted straps (11) will also act as a sort of floating anchor to reduce drift.

Figure 6:
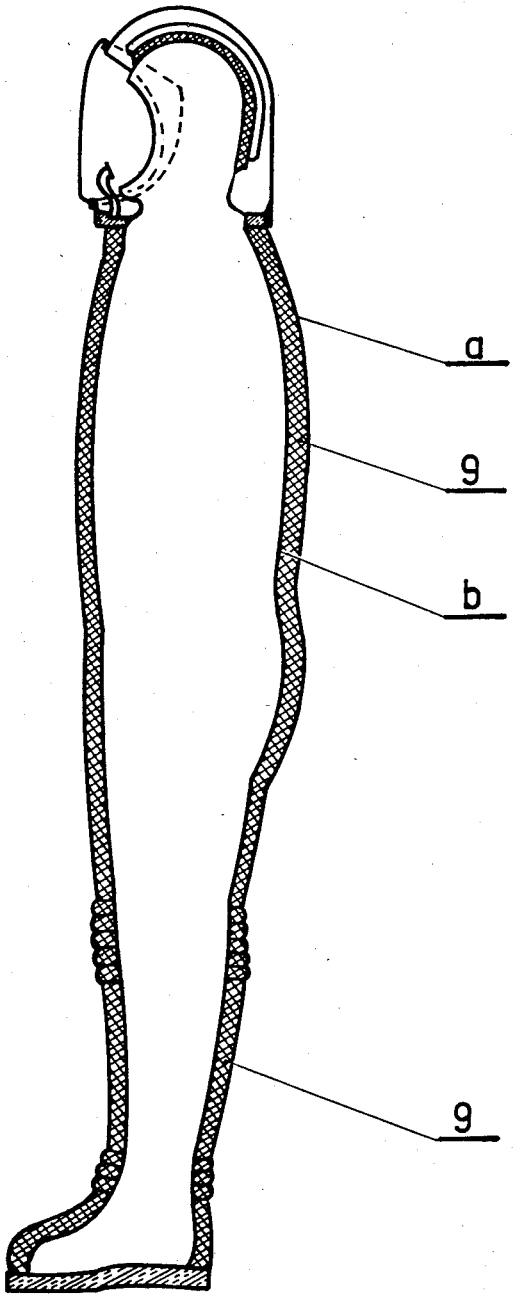
Figure 7:
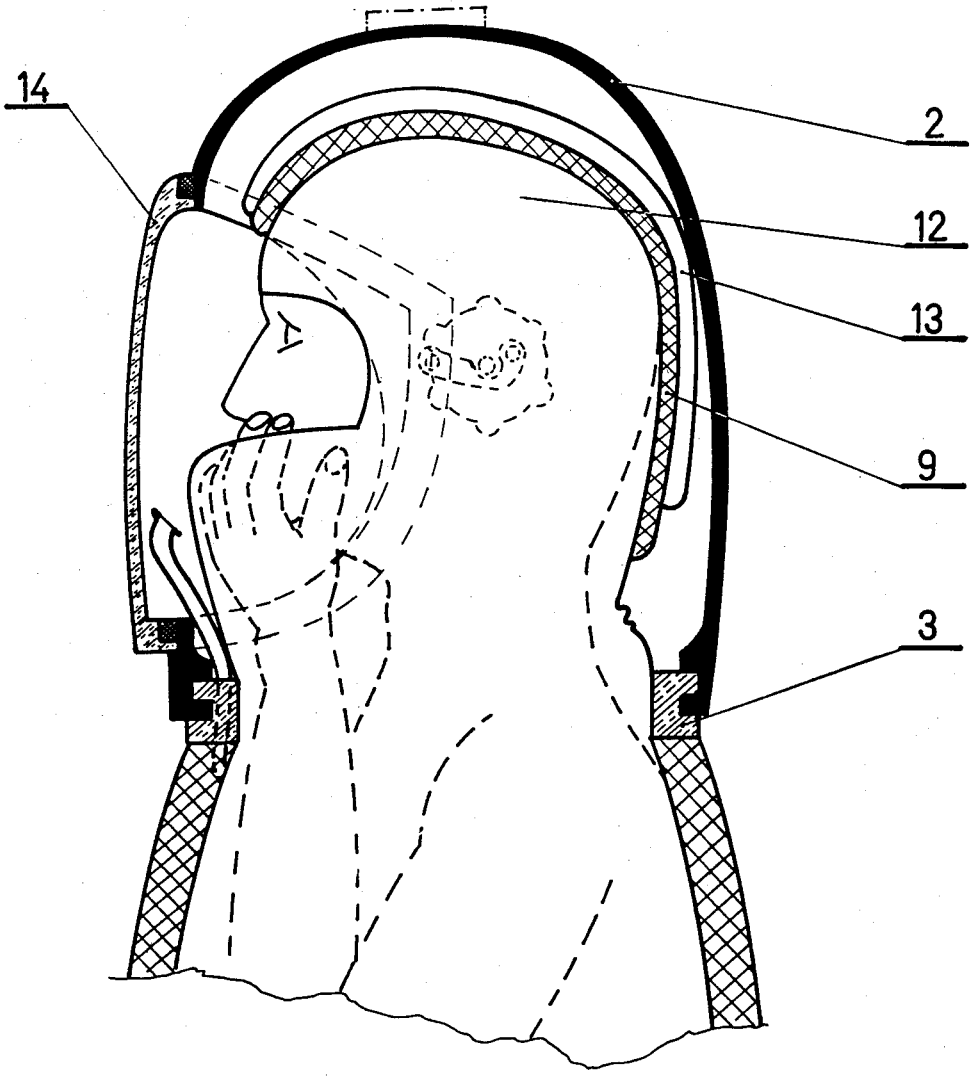

FIG. 6 shows a vertical cross section of the suit (1) with the outer skin (a) of watertight material, the inner skin (b) against the wearer's body, and between the two a layer of insulation (9). The insulation (9) is attached to both the inner and outer skins. The illustration also shows that the back and the lower legs from knee to ankle have a better and thicker insulation. This will not impair the suit's mobility as stipulated in the requirements and regulations for testing survival suits.

I claim:

1. Survival suit mainly for use in water, made of a soft and pliable material allowing the wearer to move easily and, if necessary, to swim while wearing the suit (1), the material used consisting of a watertight outer skin (a) and an inner skin (b) with in between an insulation layer (9) which holds the outer and inner skins together, the suit being characterized by a mid-section (7, 8) designed like bellows or folds (5, 7, 8) starting down at hip level and extending upwards all the way to the elbows, allowing such expansion of the suit as to enable the user to withdraw his arms from the sleeves (6) and to bring them into the main body (16) of the suit in order to attend to his personal hygienic needs and to be able to rub the parts of his body which suffer from the cold.

2. Survival suit in accordance with claim 1, built with a lower leg section (8) whose spaciousness can be altered, characterized by a leg insulation (9) which is split up vertically in order to allow for expansion so that the wearer's legs can be withdrawn from the suit legs and brought into the main body of the suit (16).

3. Survival suit in accordance with claim 2, characterized by an insulation (9) which is thicker around the head, back and legs from the knee down to the sole of the foot (FIG. 6) than on the rest of the suit (1).

4. Survival suit in accordance with claim 1, characterized by an insulation (9) which is thicker around the head, back and legs from the knee down to the sole of the foot (FIG. 6) than on the rest of the suit (1).

5. A survival suit for use by a wearer immersed in water, the survival suit comprising a garment for enclosing the body of the wearer to protect the wearer from the environment outside of the suit, the garment including an outer skin, an inner skin, an insulation layer therebetween, and expansion means for selectively altering the shape of the garment to provide either a clothes-like shape defining a set of clothes having sleeves and legs for closely fitting appendages of the wearer's body to permit the wearer to move and swim while wearing the suit or a sack-like shape defining a flexible sack surrounding the body of the wearer to permit the wearer to move his arms and legs freely within the confines of the sack while curled into a fetal position or the like and to rub the parts of his body which suffer from exposure to cold temperature.

6. The survival suit of claim 5, wherein the expansion means include first bellows means for expanding the internal volume within an upper portion of the suit, and separate second bellows means for expanding the internal volume within a lower portion of the suit, the first bellows means being formed at armpit level to enable a wearer to convert the upper portion from the clothes-like shape to the sack-like shape and vice versa by withdrawing his arms from the garment sleeves and positioning them inside the flexible sack, the second bellows means being formed at hip level to enable a wearer to convert the lower portion from the clothes-like shape to the sack-like shape and vice versa by withdrawing his legs from the garment legs and positioning them inside the flexible sack.

7. The survival suit of claim 6, wherein the first bellows means includes a pair of folded webs of garment material.

8. The survival suit of claim 6, wherein the second bellows means includes a first pair of horizontally-folded webs of garment material arranged in proximity to the wearer's waist, and a second pair of vertically-folded webs of garment material extending from the wearer's waist along the wearer's legs.

9. A survival suit for use by a wearer immersed in water, the survival suit comprising a garment forenclosing the body of the wearer to protect the wearer from the environment outside of the suit, the garment incuding a torso portion, a pair of sleeve portions coupled to the torso portion, a pair of leg portions coupled to the torso portion, first bellows means for expanding the interior volume of the torso portion to permit a wearer to withdraw his arms from the sleeve portions and position them in the expanded torso portion, the first bellows means interconnecting the pair of sleeve portions and an upper side of the torso portion, and separate second bellows means for expanding the interior volume of the torso portion to permit a wearer to withdraw his legs from the leg portions to position them in the expanded torso portion, the separate second bellows means interconnecting the pair of leg portions and a lower side of the torso portion, whereby the garment is convertible from a set of protective clothes which permit a wearer to move and swim to a protective sack inside which the wearer is able to move about and rub parts of his body.

* * * * *